US006895959B2

(12) United States Patent
Lukas

(10) Patent No.: US 6,895,959 B2
(45) Date of Patent: May 24, 2005

(54) GAS MASK AND BREATHING EQUIPMENT WITH A COMPRESSOR

(75) Inventor: Heiner Lukas, Cloppenburg (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 0 days.

(21) Appl. No.: 10/834,310

(22) Filed: Apr. 28, 2004

(65) Prior Publication Data

US 2005/0011516 A1 Jan. 20, 2005

(30) Foreign Application Priority Data

Jul. 19, 2003 (DE) ..... 103 32 899

(51) Int. Cl.[7] ..... A62B 29/00
(52) U.S. Cl. ..... 128/200.28; 128/201.24
(58) Field of Search ..... 128/200.27, 200.28, 128/201.24, 201.25, 205.25

(56) References Cited

U.S. PATENT DOCUMENTS 908,108 A * 12/1908 Knudsen ..... 128/200.27
1,646,103 A * 10/1927 Patrick ..... 128/200.27
1,917,961 A * 7/1933 Fee ..... 128/200.27
2,262,522 A * 11/1941 Yant et al. ..... 128/200.27
2,818,859 A * 1/1958 Peterson ..... 128/200.27
4,418,927 A * 12/1983 Rohm ..... 279/62
4,676,236 A * 6/1987 Piorkowski et al. ... 128/201.23
5,035,239 A * 7/1991 Edwards ..... 128/205.23
6,422,237 B1 * 7/2002 Engel et al. ..... 128/204.21
6,474,960 B1 * 11/2002 Hansmann ..... 417/363
6,615,828 B1 * 9/2003 Petherbridge ..... 128/200.28
6,651,657 B1 * 11/2003 Manigel et al. ..... 128/204.21

FOREIGN PATENT DOCUMENTS

GB 2 058 577 4/1981

* cited by examiner

*Primary Examiner*—Aaron J. Lewis
(74) *Attorney, Agent, or Firm*—McGlew and Tuttle, P.C.

(57) ABSTRACT

A gas mask and breathing equipment is provided including a compressor. The gas mask and breathing equipment provides good flushing out of the carbon dioxide during the phase of expiration with the lowest possible compressor output. An air channel (31) is formed by the visor (5) and an inner wall (4) extending in parallel to the visor and is provided in the area of the visor (5). The air is discharged through gas discharge openings (6) at the inner wall (4).

19 Claims, 8 Drawing Sheets

GAS MASK AND BREATHING EQUIPMENT WITH A COMPRESSOR

CROSS REFERENCE TO RELATED APPLICATIONS

This application claims the benefit of priority under 35 U.S.C. § 119 of German patent application DE 103 32 899 filed Jul. 19, 2003, the entire contents of which are incorporated herein by reference.

FIELD OF THE INVENTION

The present invention pertains to a gas mask and breathing equipment with a compressor.

BACKGROUND OF THE INVENTION

A gas mask and breathing equipment of the type has become known from GB 2 058 577 A. A safety helmet with a transparent visor is located at the head of a user of the device. A blower draws in ambient air via a filter and delivers it via an air channel, which extends on the inner side of the safety helmet from the nape area to the face. The breathing air then flows on the inner side of the visor in the direction of the eye area to the area of the mouth and enters the environment via an expiration valve on the underside of the visor. The visor is in contact with the face of the user of the device via a sealing lip, so that a chamber that is sealed toward the ambient atmosphere is formed between the face of the user of the device and the inner side of the visor. The breathing effort of the user of the device is measured with a pressure sensor arranged inside the chamber, and the gas flow is throttled during the phase of expiration.

The drawback of the prior-art gas mask and breathing equipment is that a comparatively high breathing gas flow is needed during the phase of expiration in order to flush the expired carbon dioxide out of the chamber. The electric power needed to drive the blower, which is supplied by a battery or a battery pack in portable devices, has an adverse effect on the operating time of the gas mask and breathing equipment, so that the user of the device must leave the site of the mission prematurely.

SUMMARY OF THE INVENTION

The basic object of the present invention is to improve a gas mask and breathing equipment of the type mentioned such that good flush-out of the carbon dioxide is achieved during the phase of expiration with the lowest possible blower output.

According to the invention, a gas mask and breathing equipment is provided including a visor which covers the face of a user of the device in such a way that a chamber, which is sealed off toward the ambient atmosphere, is formed between the face and the said visor. An inner wall extends along the visor on the side of the visor facing the user of the device and by which an air channel is formed between the visor and the inner wall. An air delivery means for breathing air is connected with the air channel. Gas discharge openings are provided at the inner wall in the area of the mouth of the user of the device. An air outlet opening is connected with the chamber.

The advantage of the present invention is essentially that an air channel is formed for the breathing air by an inner wall extending along the visor, through which air channel the breathing air purposefully reaches the mouth area of the user of the device via gas discharge openings. The breathing gas expired during the phase of expiration, which is loaded with carbon dioxide, can be flushed out by the direct flow in the mouth area directly via the air discharge opening. Due to the use of a separate air channel for supplying the breathing gas in the area of the visor, the volume of the chamber between the face of the user of the device and the inner wall can be limited to the smallest possible dead space, which additionally facilitates the flushing out of the carbon dioxide. The speed of the compressor and consequently the power consumption can be reduced due to the improved flushing out of carbon dioxide.

The flushing out of the chamber is improved by additional gas discharge openings in the lateral area of the inner wall. These additional gas discharge openings may extend over the entire lateral area of the inner wall or only over part of the lateral area. There is no increase in the local cooling and draft is minimized due to the distribution of the gas discharge openings.

The gas is advantageously fed in on the top side of the air channel. The direction of flow within the air channel is now from the eye area to the mouth area of the user of the device.

As an alternative, the gas may also be fed in symmetrically via the lateral areas of the air chamber or via the underside.

The location of the gas feed depends on the air delivery means being used.

If the visor is used in conjunction with a safety helmet and a blower as an air delivery means, the gas can be fed in on the top side of the air channel. Gas feed via the lateral surfaces or the underside of the air channel is expedient in conjunction with a compressed gas source, for example, a compressed gas cylinder.

The visor and the inner wall are expediently designed as a double pane with a peripheral fastening frame. The visor and the inner wall are fixed in relation to one another by the fastening frame, which may also be part of a mask body.

The inner wall is advantageously designed as an optical light guide with an input coupling site for light and an output site. A light-emitting diode, which is arranged at an edge of the inner wall as an input coupling site, is advantageously suitable for use as a light source. The radiation introduced by means of the light source is passed on within the inner wall to the output site by total reflection. The output site is either a gas discharge opening of the inner wall or a matt finish on the inner wall. Polycarbonate is suitable for use as the material for the inner wall. The utilization of the inner wall as an optical light guide offers the advantage that the user of the device can be informed by means of an optical warning signal when the gas supply is compromised. The light source may be arranged in a protected area at the edge of the inner wall without the sight or cleaning being hindered hereby. If a gas discharge opening is used as the output site, the circumference of the hole is illuminated by the light source. It can be achieved by the corresponding positioning of the light source that the gas discharge openings that are located directly in the field of view of the user of the device will be illuminated as the output site.

Exemplary embodiments of the present invention are shown in the drawings and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
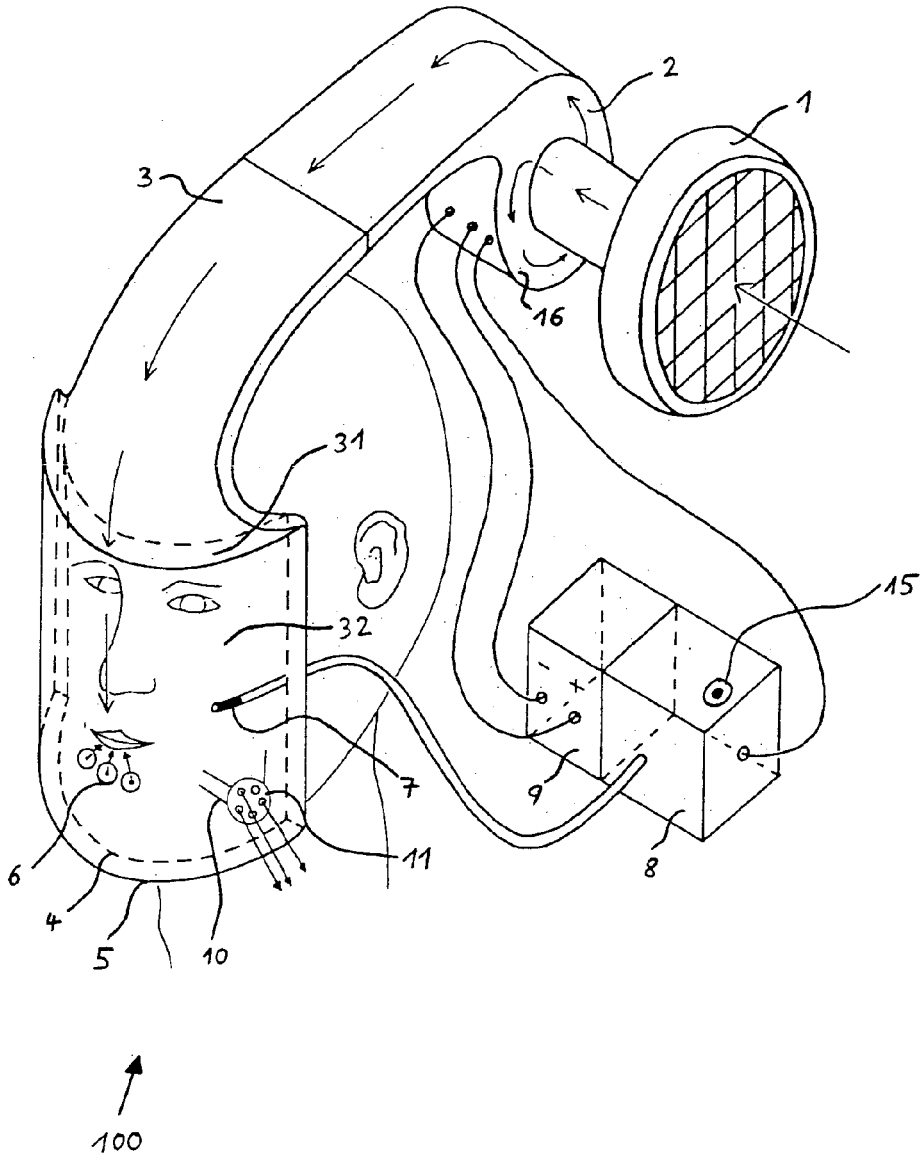
FIG. 1 is a perspective view of a gas mask and breathing equipment.

FIG. 1 schematically shows a gas mask and associated breathing equipment 100 according to the present invention. Ambient air is drawn in via a filter 1 by means of a radial flow compressor 2 (the design of the flow compressor 2 may be in accordance with features disclosed in one or more of U.S. Pat. Nos. 6,651,657; 6,474,960; 6,422,237; and 6,418,927 and U.S. application Ser. No. 10/247,087, filed: Sep. 19, 2002; Ser. No. 09/823,794, filed: Mar. 30, 2001, the contents of each of which are hereby incorporated by reference). The flow compressor delivers the air into an air channel 31 through an air guide channel 3. The air channel 31 is limited by a curved visor 5 and an inner wall 4 extending in parallel thereto. The circumferential contour of the visor 5 and the inner wall 4 is sealed, so that the breathing air flowing into the air channel 31 can be discharged into the area of the mouth of a user of the device only via gas discharge openings 6 located at the inner wall 4. Together with the inner wall 4, the visor 5 is in contact with the face of the user of the device via a seal, which is not shown specifically in FIG. 1, so that a chamber 32 that is sealed toward the environment is formed between the face of the user of the device and the inner wall 4. The breathing gas located in the chamber can flow off to the environment via an air outlet opening 10 with an expiration valve 11. Fluctuations in the pressure within the chamber 32, which develop due to the change between the phase of inspiration and the phase of expiration, are detected by means of a pressure sensor 7. The measured values are evaluated in a control unit, and the speed of the radial flow compressor 2 is adjusted correspondingly. The radial flow compressor 2 is running at an essentially constant speed during the phase of inspiration, which can be recognized from a brief pressure drop. The speed of the radial flow compressor 2 is reduced during the expiration, which leads to an increase in pressure, so that the user of the device does not have to breath out against an excessively high back pressure. The output of the compressor during the phase of expiration is designed to be such that the carbon dioxide breathed out can flow off completely via the air outlet opening 10. A battery 9 is used as the power source for the gas mask and breathing equipment 100.

Figure 2:
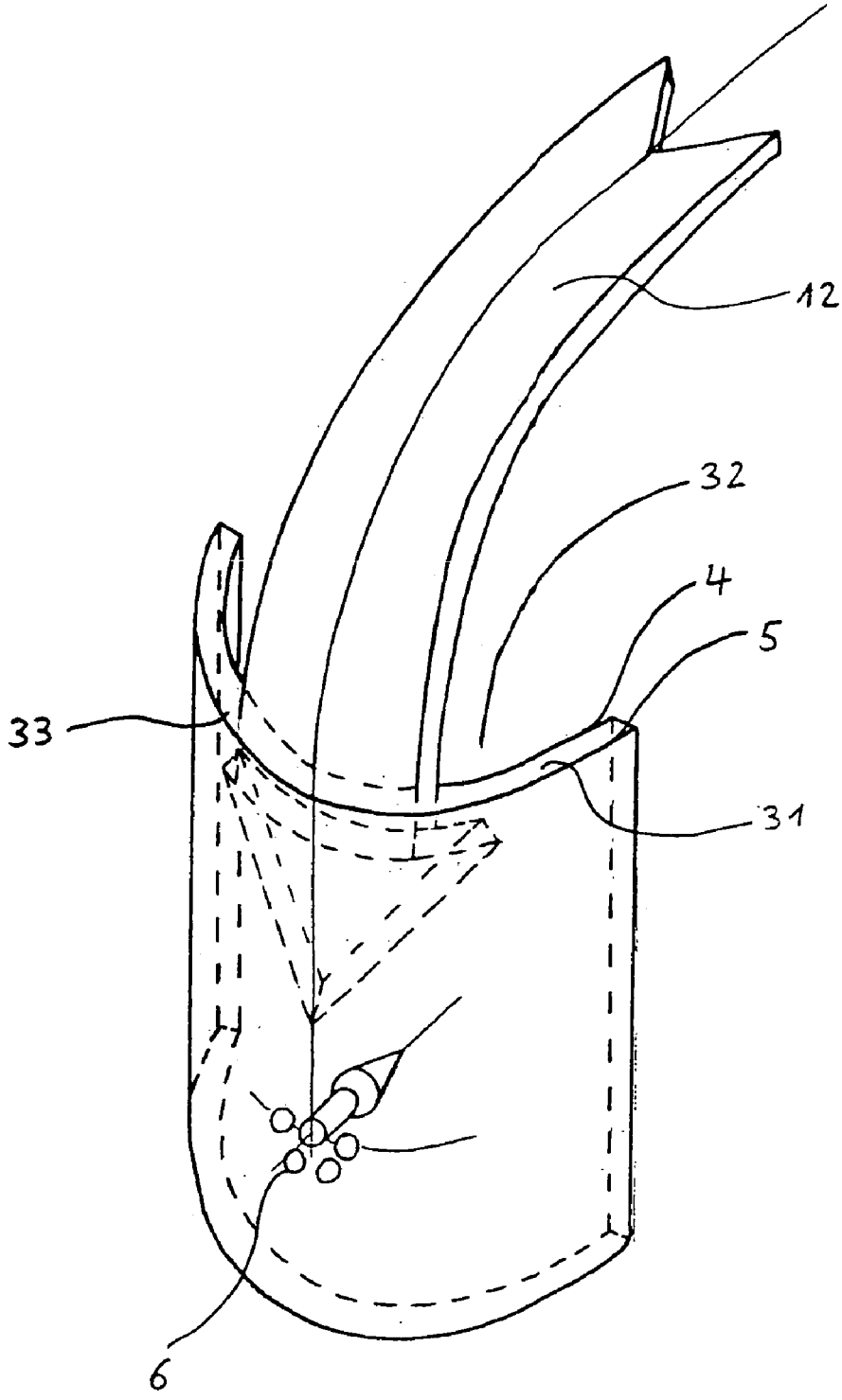
FIG. 2 is a perspective detail view of the area of the visor corresponding to FIG. 1.

FIG. 2 illustrates the air stream, which flows into the air channel 31 via the top side 33 of the channel 31 and enters the chamber 32 via the gas discharge openings 6.

Identical components are designated by the same reference numbers as in FIG. 1.

Figure 3:
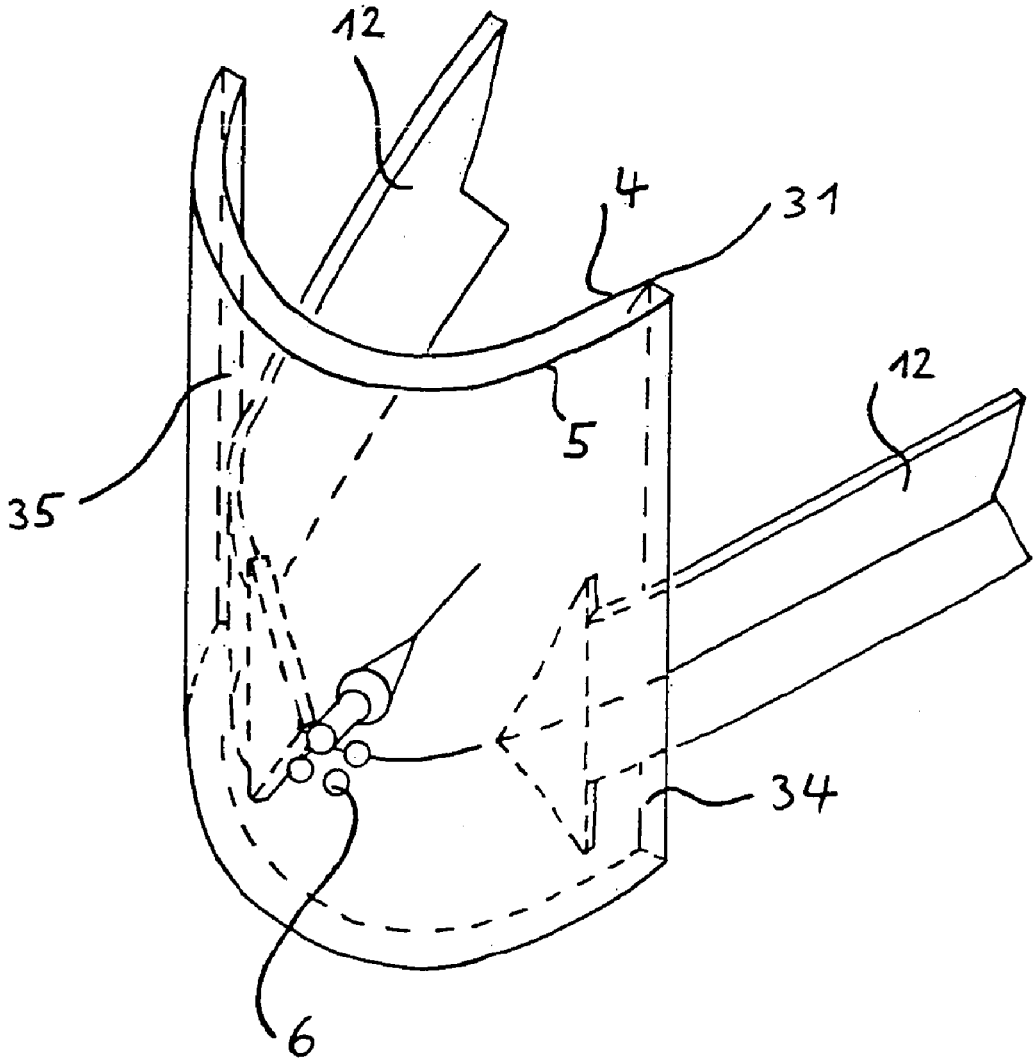
FIG. 3 is a perspective detail view showing the air channel with the gas feed via the lateral surfaces.

FIG. 3 schematically shows the air channel 31 with a gas inlet via the lateral surfaces 34, 35.

Figure 4:
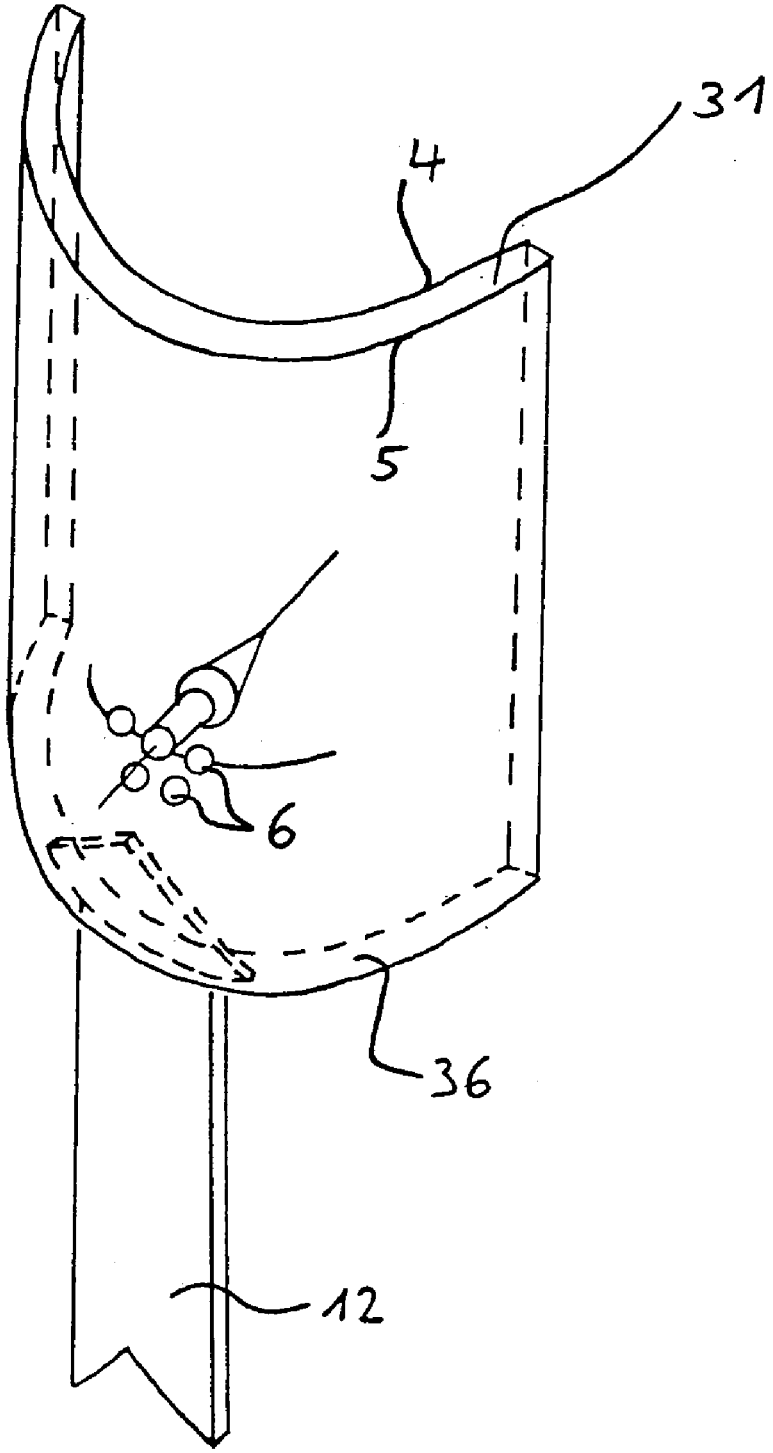
FIG. 4 is a perspective detail view showing the air channel with gas feed from the underside.

Contrary to this, the gas inlet is shown in FIG. 4 on the underside 36 of the air channel 31. Identical components are designated by the same reference numbers as in FIG. 1.

Figure 5:
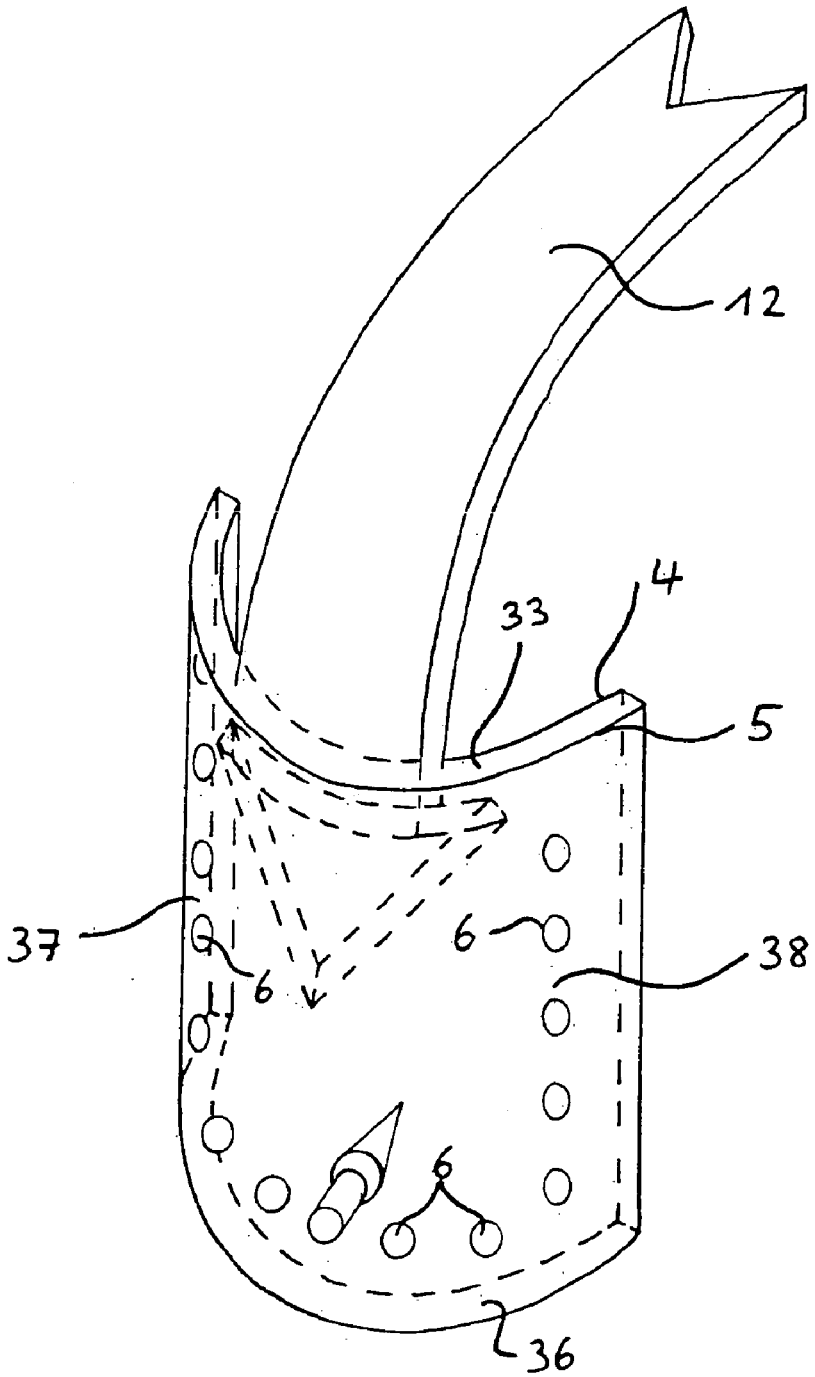
FIG. 5 is a perspective detail view showing the inner wall with additional gas discharge openings in the lateral area.

FIG. 5 schematically shows an inner wall 4 with additional gas discharge openings 6, which are arranged in the lateral areas 37, 38 of the inner wall 4. The gas discharge openings 6 extend in a U-shaped pattern along the underside 36 and then ascending into the lateral areas 37, 38.

Figure 6:
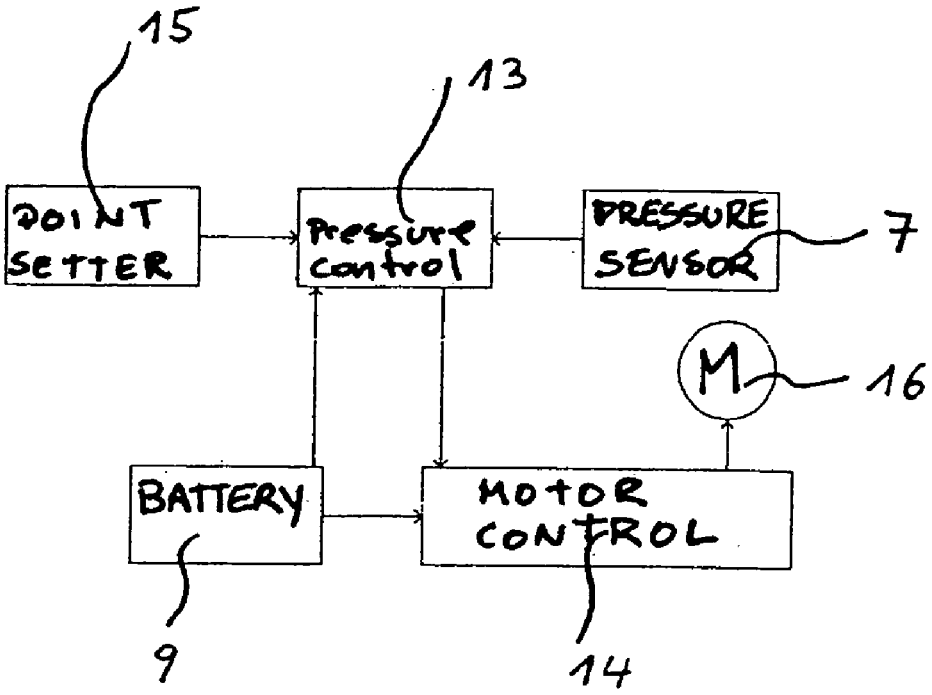
FIG. 6 is a schematic view showing a control circuit for the radial flow compressor.

FIG. 6 shows the design of the control circuit for the radial flow compressor 2, which is driven by an electric motor 16. A pressure control circuit 13 and a motor control 14 together form the control unit 8.

A mean overpressure can be preset in the chamber 32 by means of a set point setter 15.

Figure 7:
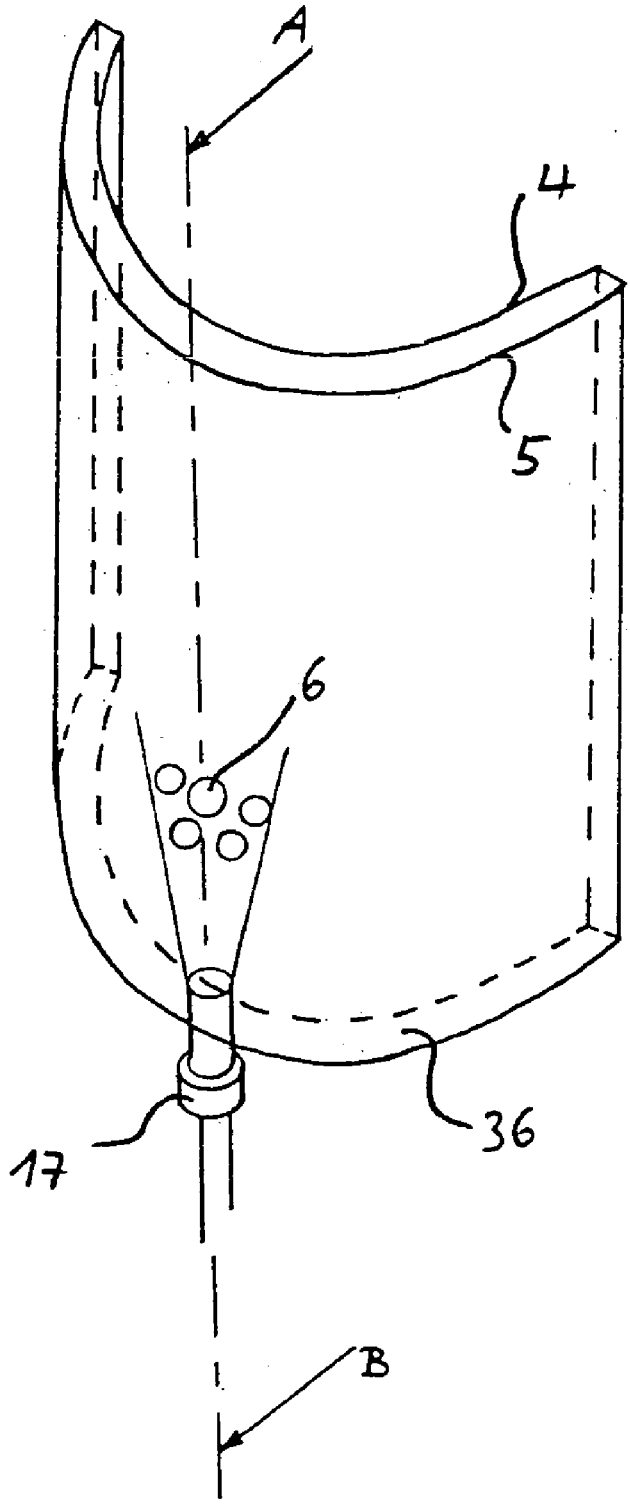
FIG. 7 is a perspective detail view showing the double pane with a light-emitting diode on the inner wall.

FIG. 7 schematically shows the visor 5 with the inner wall 4 and a light-emitting diode 17 arranged on the underside 36 of the inner wall 4. A sectional view along the section line A-B corresponding to FIG. 7 is shown in FIG. 8 for the sake of greater clarity.

Figure 8:
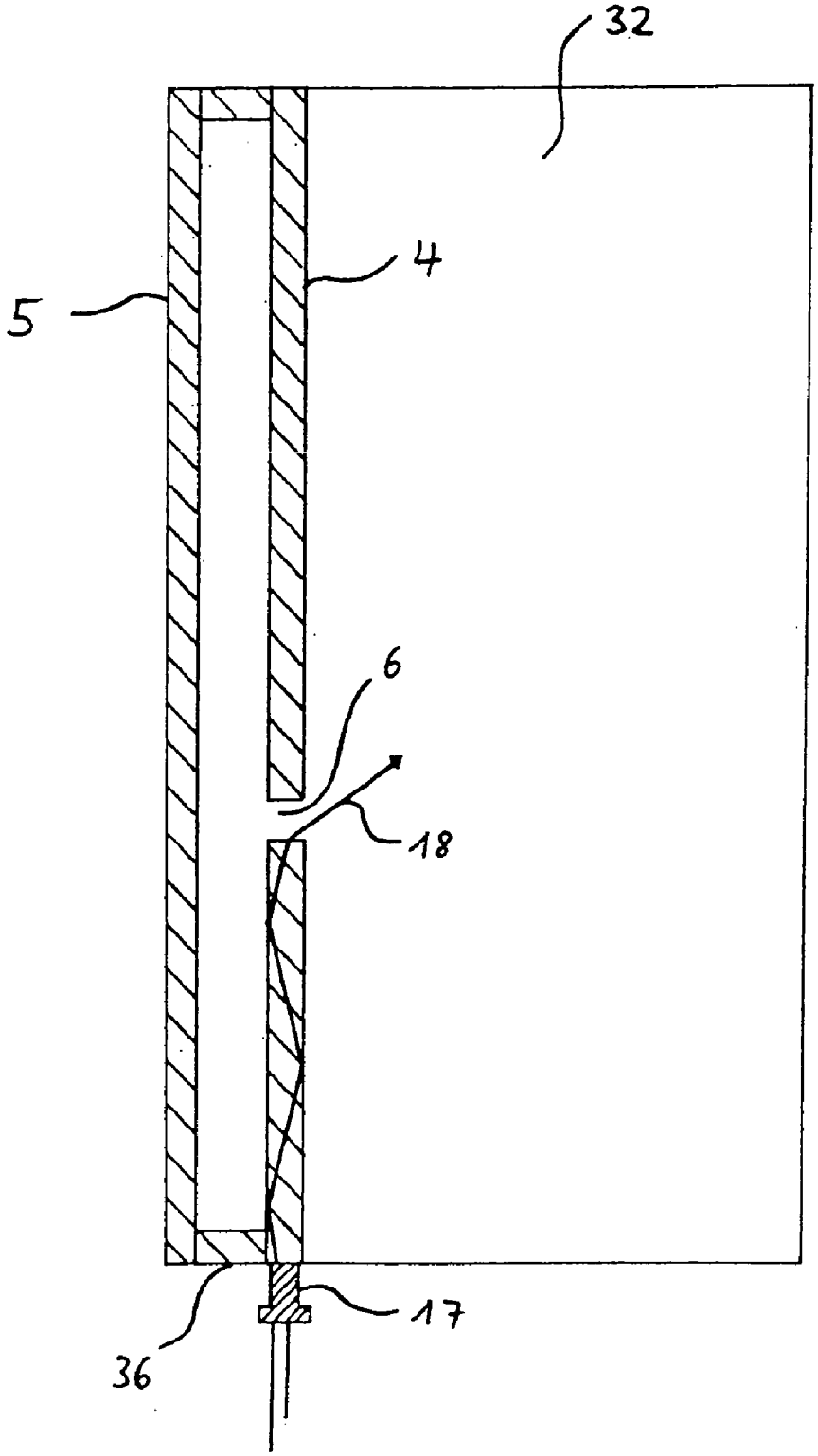
FIG. 8 is a sectional view along the section line A-B corresponding to FIG. 7.

The light beam 18 emitted by the light-emitting diode 17 is totally reflected within the inner wall 4 and deflected at the boundary surface of the gas discharge opening 6 into the area of the chamber 32, so that it can be perceived by the user of the device, who is not shown specifically in FIG. 8. The light-emitting diode 17 is connected to the motor control 14, FIG. 6, so that the light-emitting diode 17 is activated in case of a possible malfunction in order to warn the user of the device.

While specific embodiments of the invention have been shown and described in detail to illustrate the application of the principles of the invention, it will be understood that the invention may be embodied otherwise without departing from such principles.

What is claimed is:

1. A gas mask and breathing equipment, comprising:

a visor covering the face of a user in such a way that a chamber, which is sealed off toward the ambient atmosphere, is formed between the face and said visor;

an inner wall extending along said visor on a side of said visor facing the user and by which an air channel is formed between said visor and said inner wall;

an air delivery means for delivering breathing air, said air delivery means being connected with said air channel;

gas discharge openings at said inner wall in an area of the mouth of the user; and an air outlet opening connected with said chamber.

2. A gas mask and breathing equipment in accordance with claim 1, wherein said gas discharge openings are additionally arranged in a lateral area of said inner wall.

3. A gas mask and breathing equipment in accordance with claim 1, wherein the gas is fed in on the top side of said air channel.

4. A gas mask and breathing equipment in accordance with claim 1, wherein the gas is fed in via lateral surfaces of said air channel.

5. A gas mask and breathing equipment in accordance with claim 1, wherein the gas is fed in on the underside of the air channel.

6. A gas mask and breathing equipment in accordance with claim 1, wherein said visor and said inner wall are designed as a double pane.

7. A gas mask and breathing equipment in accordance with claim 1, wherein the air outlet opening is designed as a flow channel passing through said visor and said inner wall.

8. A gas mask and breathing equipment in accordance with claim 1, wherein said inner wall is designed as an optical light guide with an input coupling site for light and with an output site.

9. A gas mask and breathing equipment in accordance with claim 8, wherein said output site is at least one of the gas discharge openings.

10. A gas mask and breathing equipment system, comprising:

a visor covering the face of a user;

an inner wall extending along said visor on a side of said visor facing the user and by which an air channel is formed between said visor and said inner wall, a breathing gas region being provided on a side of said inner wall facing the user;

an air delivery device connected with said air channel;

a gas discharge opening at said inner wall in an area of the mouth of the user; and an air outlet opening connected with said chamber.

11. A gas mask and breathing equipment system in accordance with claim 10, wherein said gas discharge openings are additionally arranged in a lateral area of said inner wall.

12. A gas mask and breathing equipment system in accordance with claim 10, wherein the gas is fed in on the top side of said air channel.

13. A gas mask and breathing equipment system in accordance with claim 10, wherein the gas is fed in via lateral surfaces of said air channel.

14. A gas mask and breathing equipment system in accordance with claim 10, wherein the gas is fed in on the underside of the air channel.

15. A gas mask and breathing equipment system in accordance with claim 10, wherein said visor and said inner wall are designed as a double pane.

16. A gas mask and breathing equipment system in accordance with claim 10, wherein the air outlet opening is designed as a flow channel passing through said visor and said inner wall.

17. A gas mask and breathing equipment in accordance with claim 10, wherein said inner wall is designed as an optical light guide with an input coupling site for light and with an output site.

18. A gas mask and breathing equipment in accordance with claim 17, wherein said output site is at least one of the gas discharge openings.

19. A gas mask and breathing equipment in accordance with claim 17, wherein said air delivery device is a radial flow compressor.

* * * * *